US007086828B2

(12) United States Patent
Haje et al.

(10) Patent No.: US 7,086,828 B2
(45) Date of Patent: Aug. 8, 2006

(54) STEAM TURBINE AND METHOD FOR OPERATING A STEAM TURBINE

(75) Inventors: Detlef Haje, Bottrop (DE); Dietmar Röttger, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 93 days.

(21) Appl. No.: 10/767,678

(22) Filed: Jan. 29, 2004

(65) Prior Publication Data

US 2004/0184908 A1 Sep. 23, 2004

(30) Foreign Application Priority Data

Feb. 5, 2003 (EP) ..... 03002471

(51) Int. Cl.
*F01D 5/14* (2006.01)

(52) U.S. Cl. ..... 415/115; 416/96 R

(58) Field of Classification Search ..... 415/115, 415/116, 117, 100, 102, 103; 416/96 R, 416/198 A See application file for complete search history.

(56) References Cited

U.S. PATENT DOCUMENTS

| | | | | |
|---|---|---|---|---|
| 288,240 | A | 11/1883 | Ittner | |
| 6,102,654 | A | 8/2000 | Oeynhausen et al. | |
| 6,315,520 | B1 * | 11/2001 | Haje et al. | 415/178 |
| 6,626,637 | B1 * | 9/2003 | Kreitmeier | 415/1 |

FOREIGN PATENT DOCUMENTS

| | | | |
|---|---|---|---|
| CH | 307094 | | 5/1955 |
| CH | 379839 | | 8/1964 |
| DE | 451 857 | | 11/1927 |
| DE | 1 034 193 | | 12/1957 |
| DE | 1 601 845 | | 2/1971 |
| DE | 3406071 | A1 | 8/1984 |
| DE | 19819508 | A1 * | 11/1999 |
| EP | 1 154 123 | A1 | 11/2001 |
| FR | 1 092 807 | | 4/1955 |
| FR | 1 134 328 | | 4/1957 |
| JP | 58155203 | | 9/1982 |
| JP | 61001809 | | 1/1986 |
| WO | WO 97/49901 | | 12/1997 |

OTHER PUBLICATIONS

Von H.G. Neft und G. Franconville; Neue Dampfturbinenkonzepte fur hohere Eintrittsparameter und langere Endschaufein; VGB Kraftwerkstechnik 73 (1993), Heft 5; pp. 409-415.

* cited by examiner

*Primary Examiner*—Edward K. Look
*Assistant Examiner*—Dwayne J White

(57) ABSTRACT

A steam turbine (20) having a rotor (21) which is provided with a number of rotor blades (22) and, together with a number of guide vanes (24), is arranged inside a casing shell (30) formed from a number of casing segments is to be designed to be suitable for operation with relatively high steam parameters, i.e. in particular with a particularly high steam temperature and a particularly high steam pressure. For this purpose, according to the invention active cooling of the casing shell (30) is provided, at least one of the casing segments which form the casing shell being provided with a number of integrated cooling channels (29). When the steam turbine (20) is operating, therefore, the casing shell (30) is actively cooled with a cooling medium by the latter being supplied to the cooling channels (29).

13 Claims, 5 Drawing Sheets

STEAM TURBINE AND METHOD FOR OPERATING A STEAM TURBINE

CROSS REFERENCE TO RELATED APPLICATIONS

This application claims priority to the European application No. 03002471.5 EP, filed Feb. 5, 2003 under the European Patent Convention and which is incorporated by reference herein in its entirety.

FIELD OF INVENTION

The invention relates to a steam turbine having a rotor, which is provided with a number of rotor blades and, together with a number of guide vanes, is arranged inside a casing shell formed from a number of casing segments. It also relates to a method for operating a steam turbine of this type.

BACKGROUND OF INVENTION

In the context of the present application, the term steam turbine is to be understood as meaning any turbine or part-turbine through which a working medium in the form of steam flows. By contrast, gas turbines have gas and/or air flowing through them as working medium, but this medium is subject to completely different temperature and pressure conditions than the steam in a steam turbine. Unlike in gas turbines, in steam turbines the working medium flowing to a part-turbine, for example, reaches its highest pressure at the same time as it is at its highest temperature. Therefore, an open cooling system, as in gas turbines, cannot be realized without a supply from the outside of the part-turbine.

A steam turbine usually comprises a rotor which is fitted with blades, is mounted rotatably and is arranged inside a casing shell. When heated and pressurized steam flows through the interior of the flow space formed by the casing shell, the rotor is made to rotate by the steam via the blades. The blades of the rotor are also known as rotor blades. Furthermore, stationary guide vanes which penetrate into the spaces between the rotor blades are usually attached to the casing shell. A guide vane is usually held along an inner side of the steam turbine casing at a first location. In this form, it is usually part of a ring of guide vanes which comprises a number of guide vanes which are arranged along an inner circumference on the inner side of the steam turbine casing. The main vane part of each guide vane faces radially inward. A ring of guide vanes at the above mentioned first location along the axial extent is also referred to as a row of guide vanes. A number of rows of guide vanes are usually positioned one behind the other. Accordingly, a further, second vane is held along the inner side of the steam turbine casing at a second location behind the first location along the axial extent.

The casing shell of a steam turbine of this type may be formed from a number of casing segments. The casing shell of the steam turbine is to be understood as meaning in particular the stationary casing component of a steam turbine or part-turbine which, along the axial extent of the steam turbine, has an inner space which is provided for the working medium steam to flow through. Depending on the type of steam turbine, this may be an inner casing and/or a guide vane carrier. However, it is also possible to provide a turbine casing which does not have an inner casing or a guide vane carrier.

For efficiency reasons, the design of a steam turbine of this type for what are known as "high steam parameters", i.e. in particular high steam pressures and/or high steam temperatures, may be desirable. However, for materials science reasons, it is not possible in particular to increase the temperature without restriction. To allow the steam turbine to operate reliably even at particularly high temperatures, the cooling of individual parts or components may be desirable.

With the coolant methods which have been disclosed hitherto, in particular for a steam turbine casing, a distinction has to be drawn between active cooling and passive cooling. In the case of active cooling, cooling is brought about by a cooling medium which is fed to the steam turbine casing separately, i.e. in addition to the working medium. By contrast, passive cooling is brought about only by suitably guiding or using the working medium. Standard cooling of a steam turbine casing is restricted to passive cooling. For example, it is known for cool, ready-expanded steam to flow around an inner casing of a steam turbine. However, this has the drawback that a temperature difference across the inner casing wall has to remain restricted, since otherwise the inner casing would be excessively thermally deformed in the event of an excessively high temperature difference. Although heat is dissipated with flow around the inner casing, the dissipation of heat takes place relatively far away from the location where it is supplied. Hitherto, it has not been possible to achieve sufficient dissipation of heat in the immediate vicinity of where the heat is supplied. Further, passive cooling can be achieved by suitable implementation of the expansion of the working medium in what is known as a diagonal stage. However, this only makes it possible to achieve a very limited cooling action on the casing.

U.S. Pat. No. 6,102,654 describes active cooling of individual components inside a steam turbine casing, the cooling being restricted to the inflow region of the hot working medium. As shown in FIG. 1 of this application, according to U.S. Pat. No. 6,102,654 cooling medium is passed through the casing onto a protective shield and onto a first ring of guide vanes, in order to reduce the thermal load on the rotor and the first ring of guide vanes. Some of the cooling medium is admixed with the working medium. The cooling is in this case supposed to be brought about by flow onto the components which are to be cooled.

It is known from WO 97/49901 for a single ring of guide vanes to be acted on selectively by a medium, through a separate, radial channel in the rotor which is supplied from a central cavity, in order to shield individual regions of the rotor. For this purpose, the medium is admixed with the working medium via the channel, and cooling medium flows selectively onto the ring of guide vanes. However, with the central hollow bore of the tube which is provided for this purpose, it is necessary to accept increased centrifugal force stresses, which constitutes a significant drawback in terms of design and operation.

EP 1154123 has described a possible way of removing and guiding a cooling medium from other regions of a steam system and the supply of the cooling medium in the inflow region of the working medium.

To achieve higher efficiency levels in the generation of power using fossil fuels, there is a need to employ higher steam parameters, i.e. higher pressures and temperatures, than has hitherto been customary in a turbine. In this context, if steam is used as the working medium, pressures of in some cases well over 200 bar and temperatures of in some cases well over 500° C. are intended. Steam parameters of this nature are described in detail in the article "Neue Dampfturbinen-konzepte für höhere Eintrittsparameter und län-gere Endschaufeln" [Novel steam turbine concepts for higher entry parameters and longer end blades] by H. G. Neft and G. Franconville in the Journal VGB Kraftwerkstechnik, No. 73 (1993), Volume 5. The content of disclosure of this article is hereby incorporated by reference in the description of the present application. In particular, examples of higher steam parameters are cited in FIG. 13 of the article. In the abovementioned article, a cooling steam supply and passage of the cooling steam through the first row of guide vanes and if appropriate also through the second row of guide vanes is proposed in order to improve the cooling of a steam turbine casing. Although this provides active cooling, it is restricted to the main flow region of the working medium and is still in need of improvement.

Therefore, all the methods which have been disclosed hitherto for cooling a steam turbine casing, if they are active cooling methods at all, at best provide for a directed flow onto a separate turbine part which is to be cooled and are restricted to the inflow region of the working medium, at most including the first ring of guide vanes. When higher steam parameters are applied to standard steam turbines, an increased thermal load may result over the entire turbine, and this load could only be alleviated to an insufficient degree by standard cooling of the casing as described above. Steam turbines which fundamentally use higher steam parameters in order to achieve higher efficiencies require improved cooling, in particular of the casing, in order to sufficiently break down the higher thermal load on the steam turbine. This gives rise to the problem that when turbine materials which have hitherto been customary are employed, the increasing load on the casing resulting from increased steam parameters may lead to a disadvantageous thermal load on the casing, and consequently these may no longer be technically feasible.

SUMMARY OF INVENTION

Therefore, it is an object of the present invention to provide a steam turbine of the type described above which is particularly suitable for operation with "high steam parameters". Moreover, it is intended to provide a method for operating a steam turbine which is particularly suitable for the above.

With regard to the steam turbine, this object is achieved, according to the invention, by at least one of the casing segments being provided with a number of integrated cooling channels.

In this context, the invention is based on the consideration that one limiting factor with regard to possible increases in the temperature of the flow medium is the casing wall itself. Therefore, the steam turbine was to be provided with a reliably coolable casing shell. This can be achieved by virtue of a number of cooling channels being provided in the immediate vicinity of the cooling required, i.e. directly inside the casing shell or the casing segments which may form it.

In this context, the term "cooling channel" is to be understood as meaning in particular a flow channel for a coolant which is used not only to transport or transfer the coolant but also in which, for design reasons, a cooling effect on the surroundings, i.e. in particular the corresponding casing segment, occurs when coolant is supplied.

In order in this context to achieve a particularly reliable cooling action which satisfies requirements, the cooling channels are advantageously routed relatively close to the inner surface of the casing shell. This is based on the discovery that particularly when relatively hot flow medium is being guided inside the casing shell, the thermal load on the inner surface of the latter is particularly high. Cooling which satisfies the requirements particularly well can therefore be achieved by the corresponding cooling channel advantageously being positioned inside the wall of the corresponding casing segment, offset toward the inner surface, i.e. toward the surface which delimits the inner or flow space, relative to the center plane of the corresponding wall.

The cooling channels are advantageously designed for relatively large-area cooling of the casing wall and for this purpose extend over a certain minimum length as seen in the longitudinal direction of the rotor. Therefore, the cooling channels, substantially following the contour of the casing, are expediently oriented substantially in the longitudinal direction of the rotor.

In this context, the minimum length as seen in the longitudinal direction of the rotor is advantageously provided to be a length which spans a plurality of, at least two, vane/blade rows.

This has the significant advantage that the cooling of a steam turbine casing takes place continuously not just over a plurality of blade/vane rows, i.e. at least between a first region arranged in front of the first location-and a second region arranged behind the second location, but also has the advantage that the dissipation of heat takes place in the immediate vicinity of where the heat is supplied, specifically within the casing. In this way, the cooling used in standard steam turbines is improved, meaning that they could be produced at lower materials costs. Furthermore, the proposed cooling concept makes it possible to design new steam turbine concepts for higher entry parameters. Examples of higher steam parameters are to be found in the above-referenced article "Neue Dampfturbinen konzepte für höhere Eintrittsparameter und längere Endschaufeln". Examples for the steam parameters of the steam as a working medium are 250 bar and 540° C. or 300 bar and 600° C.

Advantageous refinements of the invention are to be found in the subclaims relating to the steam turbine casing and provide details of advantageous ways of developing the proposed casing with a view to achieving the abovementioned and further advantages.

A particularly preferred refinement provides a number of further locations, at each of which a vane is held, between the first location and the second location. In particular, the cooling channels are advantageously part of a combined cooling system which is integrated in the casing shell and extends along the axial extent of the steam turbine casing. This provides the option of guiding cooling steam parallel to the main flow. The cooling of a plurality of blade/vane rows is as far as possible allowed to take place along the entire casing. The cooling channels may in this case advantageously be routed via associated passages through guide vanes anchored in the casing. In addition or as an alternative, it would be possible to provide a first number of passages which each extend continuously over one or more blade/vane rows along the axial extent. They could in this case be connected to form a passage system via further, second passages, oriented radially or in any other desired way. The at least one passage or the first number of passages are in this case advantageously arranged close to the surface. The further, second passages could also run inside the wall or lead out of the wall, as desired.

It is expedient to provide an open cooling system which provides the option of matching the parameters of the cooling medium to the parameters of the working medium. This is explained in more detail below with reference to the proposed method.

The text which follows describes further advantageous configurations of a passage system, of which the cooling channels according to the proposed concept form part. A passage system of this type is advantageously arranged close to the surface on the inner side of the steam turbine casing. In this context, the term close to the surface means in particular that the cooling system is arranged in a region of the radial extent of the steam turbine casing which is delimited by the inner side of the casing on one side and the outer radial extent of a guide vane groove on the other side. The cooling channels may, depending on the particular requirements, advantageously be designed as an actual channel or as any desired form of cavity between the outer side and the inner side of the casing. This allows further improvement to the dissipation of heat at the location where heat is introduced.

The proposed cooling concept inside the abovementioned steam turbine casing therefore acts more effectively than cooling which acts on the inner casing on the outer side of a casing wall by expanded steam with a relatively low steam density flowing around it. Furthermore, advantages supervise in terms of the deformation characteristics of a steam turbine casing. The cooling using the proposed concept also reinforces the benefit of thermally insulating layers on casing and/or vanes. Layers of this type have a relatively low heat conduction coefficient and can build up a high temperature difference, provided that a sufficient heat sink is provided. This means that casing, vane roots and in some cases also main vane parts can be held at a significantly lower temperature than without a thermally insulating layer. As an alternative to an insulating layer, or in combination with such a layer, it may be useful, when employing the proposed cooling concept, to use vane materials of less good thermal conductivity. A preferred example of such materials is formed by authentic materials.

The cooling system expediently includes a branch channel which at least partially encircles a circumferential extent of the casing. Together with the cooling channels which are in any case provided, this allows the steam turbine casing to be cooled over its entire periphery, preferably in the vicinity of its inner side.

The parameters of the cooling medium are advantageously adapted in steps, by means of an open cooling system, as a function of the parameters of the working medium, in such a manner that the cooling medium flows over into the working medium with only a relatively minor pressure difference. For this purpose, the or each cooling channel is expediently connected to the flow space, surrounded by the casing shell, for the flow medium via a number of overflow openings. The channel system and the overflow openings are expediently designed in a suitable way with regard to this design criterion, so that the flow resistance makes it possible to match the pressure level in the cooling medium. The dimensions are preferably selected in such a manner that in the operating state the coolant locally, i.e. in particular in each case in the same turbine stage, is at a slightly higher pressure, for example a pressure which is approximately 0.1% to 25% higher, than the flow medium. For this purpose, the first region expediently has a first opening to the main flow. The second region advantageously has a second opening to the main flow. This allows cooling of a plurality of blade/vane rows, with the cooling medium in each case being at a pressure which is similar to, in particular slightly higher than, that of the main flow, so that the differential pressure stresses are advantageously minimized.

According to a refinement, the inner side of the casing may be formed by an inner side of the inner wall, i.e. the cooling channels could be integrated in the wall as a bore, groove or in some other suitable way. Furthermore, it has proven very particularly favorable for the inner side of the casing to be formed by a stationary shielding plate. This allows the steam turbine casing to be completely shielded from the main flow in an advantageous way in the cooled balding region. This has significant advantages with regard to oxidation of the casing material. A stationary shielding plate could expediently be held by a vane, in particular a vane root.

The cooling channels can be designed as required. For example, it has proven expedient for the passage to run through a vane, in particular through a vane root. In this case, a groove at a vane root could form part of the channels. If appropriate, it would also be possible for a bore running through a single vane root or, as an alternative or in addition, through two adjacent vane roots to form part of the channels. Furthermore, it has proven expedient to provide a channel, which is connected to the passage, in a main vane part. This allows advantageous cooling of the main guide vane part region by means of film cooling.

The coolant provided is advantageously steam, which can be taken from the water-steam circuit of the power plant at locations which are suitable for operation of the cooling channels, in particular the required operating pressure.

With regard to the method, the abovementioned object is achieved by virtue of a casing shell, which delimits the flow space for the flow medium, being supplied with coolant at least partially via a number of integrated cooling channels.

Since the working medium which flows into a steam turbine at its highest temperature is simultaneously also at its highest pressure, it is particularly expedient for the cooling medium to be fed to the steam turbine casing from the outside. In this case, the pressure of the cooling medium advantageously exceeds the local pressure of the working medium in the main flow.

It has proven particularly expedient for the cooling medium to be guided at a pressure which is modified as a function of a pressure of the main flow, and in particular for the cooling medium flow to be throttled. This refinement makes it possible to design an open cooling system which is adapted for higher steam parameters. Throttling of the cooling medium in order to match the pressure to the main flow, in an advantageous configuration, takes place in steps by using suitably selected flow resistances in the channel system in conjunction with corresponding openings to the main flow in the at least one passage.

Furthermore, the cooling medium is expediently supplied at a temperature and/or in an amount which is/are modified as a function of a temperature of the main flow. This can advantageously be controlled by a fitting which satisfies safety requirements and in terms of control engineering tracks the quick-closing and actuating operations of the turbine valves. In the event of an absence of cooling medium, operation of the turbine can if necessary be interrupted with the aid of the turbine valves, which is referred to as a quick closure. The temperature of the cooling medium is advantageously to be set according to safety requirements and to be monitored by control engineering. If appropriate, in the event of a weak load, a disproportionate amount of cooling medium can be introduced into the working medium, so that the temperature of the main flow is kept at a sufficiently low level downstream of the cooled blading region by increased introduction of cooling medium.

The concept of supplying the cooling medium and guiding the cooling medium in a passage system which is integrated in the casing, advantageously close to the surface, as explained above, can be designed and modified according to the particular requirements.

According to a variant of the invention, the proposed concept can also be used to start up and/or quickly cool down a turbine.

The present invention also makes it possible to use less expensive materials, with a lower resistance to heat, for modern steam parameters.

An exemplary embodiment of the invention is explained in more detail with reference to a drawing.

The preferred embodiment of the invention is described in connection with a cooling system which provides a pressure-matched mass flow of cooling steam which is able to cool the statically loaded components, i.e. the casing and the guide vanes, in a targeted manner. Consequently, the preferred embodiment proposed here can make a significant contribution to inexpensive, large-scale feasibility of higher steam parameters and higher efficiencies. Furthermore, the embodiment of the invention as described here, or a slightly different, modified embodiment, can also be implemented in order to allow the use of less expensive casing and blade materials for current steam parameters.

DETAILED DESCRIPTION OF INVENTION

Figure 1:
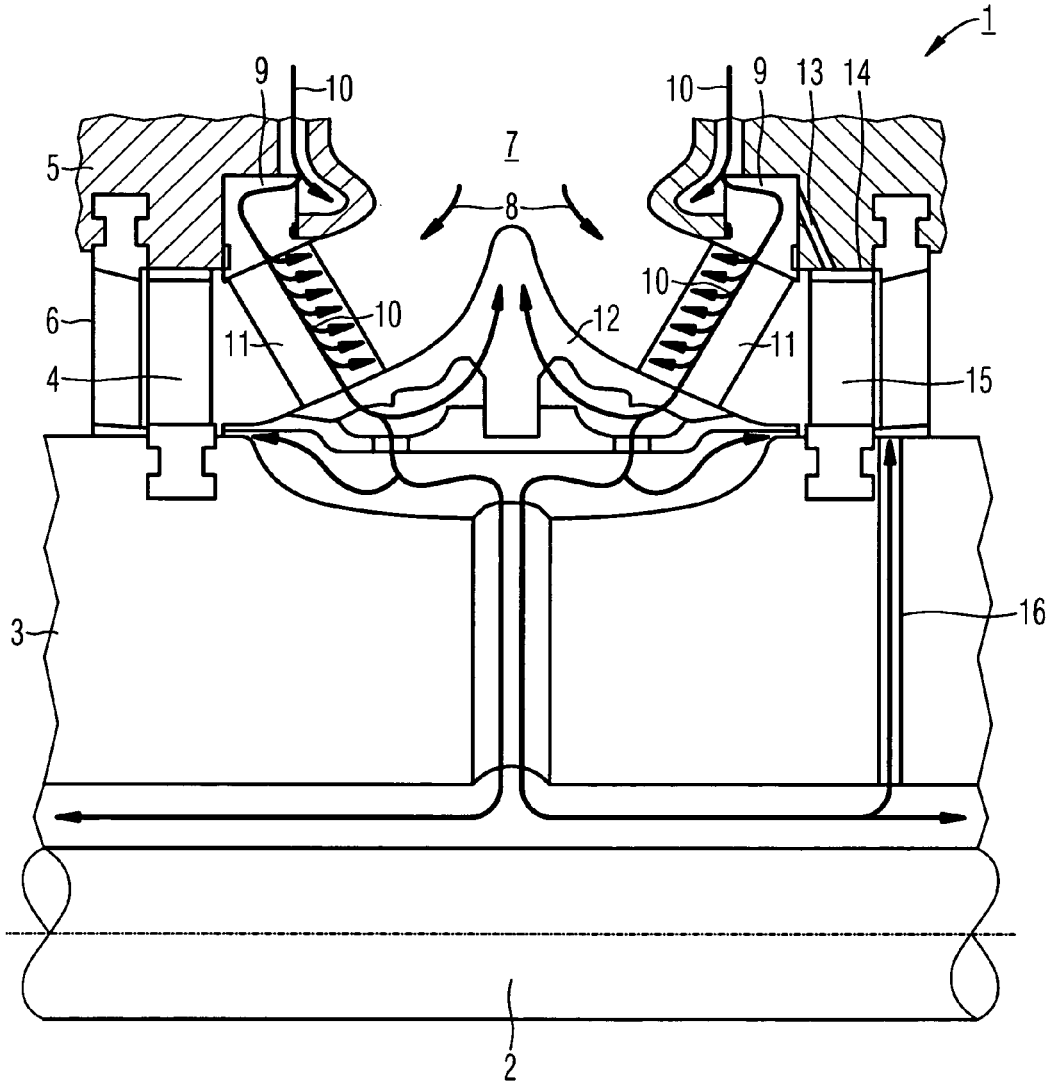
FIG. 1 shows a known cooling concept for a steam turbine casing which is restricted to cooling in the inflow region of the working medium and to the cooling of the first ring of guide vanes.

FIG. 1 shows a diagrammatic illustration of a steam turbine 1 as described in the prior art in accordance with U.S. Pat. No. 6,102,654. This turbine has a rotor 3 arranged rotatably on an axle 2, with a number of rotor blades 4. These rotor blades are arranged in a stationary casing 5 with a set of guide vanes (guide vane blading) 6. The rotor 3 is driven via the rotor blades 4 by the working medium 8, which flows in in the inflow region 7. In addition to the working medium 8, a cooling medium 10 flows to the working medium 8 via a separate inlet region 9. The cooling medium 10 performs a cooling action only on a first ring 11 of guide vanes of the stationary guide vane blading and a shielding plate 12 by flowing onto them. As a result, the thermal load on the rotor 3 in the inflow region and on the first ring 11 of guide vanes is reduced. Moreover, cooling medium 10 from the inlet region 9 is passed beyond the first ring 11 of guide vanes, via a blocking line 13, to a region 14 which is located directly between the casing 5 and the first rotor blade 15. In this way, the inlet region 9 of the cooling medium 10 is sealed off with respect to the working medium 8, with the cooling medium 10 acting as a blocking fluid. The blocking line 13 does not act as a cooling line.

Figure 2:
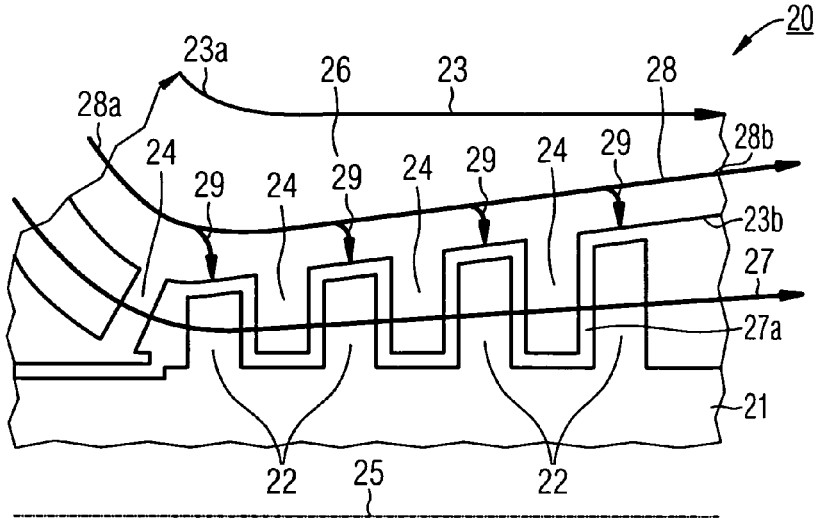
FIG. 2 diagrammatically depicts a cooling concept in a steam turbine casing in accordance with a preferred embodiment.

FIG. 2, by contrast, diagrammatically depicts a steam turbine 20 in accordance with a particularly preferred embodiment of the invention. The steam turbine 20 has a rotor 21 with a number of rotor blades 22 arranged thereon, the rotor being mounted rotatably in a casing shell 23 with a number of guide vanes 24. The steam turbine 20 with rotor 21 and casing shell 23 extends along an axial extent of an axis 25. The rotatable rotor blades 24 engage like fingers into spaces between the stationary guide vanes 24.

The casing shell 23 illustrated here could be designed as an inner casing or as a guide vane carrier and/or could be formed by a number of casing segments in the style of a segmented design. The wall 26 of the steam turbine casing has an outer side 23*a*, which in this case is also the outer side of the casing shell 23. The steam turbine casing also has an inner side 23*b*. The inner side 23*b* adjoins an inner space 27*a* which is intended to receive a main flow 27 of a fluid working medium. The casing shell 23 has a number of locations on the inner side 23*b*, at each of which a guide vane 24 is held. In this case, according to the particularly preferred embodiment, a channel system 28 for guiding a cooling medium, arranged between the outer side 23*a* and the inner side 23*b*, extends continuously from a first region 28*a*, past the locations for the guide vanes 24, to a second region 28*b*.

The channel system 28, which is therefore provided as a cooling system, comprises a number of cooling channels 29 which are integrated in the casing shell 23, run relatively close to the inner surface of the casing shell 23 and are oriented substantially in the longitudinal direction of the rotor 21.

Along the axis 25, the channel system 28 has a number of overflow openings 29*a* to the main flow 27. By interacting with the through-openings of the channel system 28, these openings 29*a* serve to reduce the pressure of the cooling medium in steps, in parallel with the main flow 27. From stage to stage of the guide vanes 24, the cooling medium can preferably be throttled through flow resistances, which are not shown here. The passage of the cooling medium through a bore, for example, at each row of guide vanes, is suitable for this purpose. During the throttling, the pressure is reduced without any technical work being performed. The cooling medium, at a similar pressure and lower temperature, has a higher density than the flow medium, resulting in improved heat transfer properties. The increase in volume of the cooling medium which is brought about by throttling and a temperature increase can advantageously be compensated for by some of the cooling medium gradually being released to the main flow via the overflow openings 29*a*. This also ensures that the cooling medium pressure is well matched to the pressure of the main flow. The embodiment described here therefore provides an open cooling system. The dimensions of the cooling channels 29 and of the overflow openings 29*a* are in particular selected in such a manner that in the operating state the cooling medium locally is at a slightly higher pressure, for example a 25% higher pressure, than the flow medium.

In principle, a variant in the form of a closed cooling system (not shown here) could also be provided in the preferred embodiment of a steam turbine casing. This does have certain drawbacks, but depending on particular requirements, these can be accepted if desired. In the case of a closed cooling system, the cooling medium is only released to the main flow 27 at the end of the cooled region. In this case, therefore, the overflow openings 29*a* of the open system shown in FIG. 2 would be substantially dispensed with. Cooling medium would simply be passed from a first region 28*a* to a second region 28*b*, without any significant pressure matching to the main flow. The stepped reduction in pressure could also be performed by throttling.

In any event, there is no release of cooling medium to the main flow at each blade/vane row. Therefore, in the case of a closed cooling system, by way of example the cooling medium can simply not be released to the main flow 27 at all, can be released to the main flow 27 only in the second region 28*b* or can only be released to the main flow 27 at a greatly reduced number of stages. Consequently, the pressure in the channel system 28 is only indirectly matched to the main flow 27. A drawback of this is that the cross sections required for the cooling medium grow in size significantly over the course of the channel system 28 as a result of the temperature rise and pressure drop in a closed cooling system.

This leads to an undesirable reduction in the bearing cross sections of vane roots and/or the casing, since designing the channel system 28 as a closed channel system 28 would mean that its cross section would have to grow from a first region 28*a* toward a second region 28*b* in order to take account of an increase in the volumetric flow. Although this runs contrary to the strength requirements in the casing and vane securing region, it could be compensated for. If it is not intended for it to be possible for the cooling medium to be released to the working medium after it has performed its cooling task, for example on account of excessively different pressure and temperature parameters, the cooling medium would be guided out of the casing shell 23 separately from the working medium in a region 28*b*. Depending on the expansion range covered, a high pressure difference between flowing medium in the main flow 27 and the cooling medium in the closed channel system 28 is established in the case of a plurality of stages being cooled with a closed system if the overflow openings 29*a* shown in FIG. 2 are not present. Depending on the choice of coolant pressure, this would be characterized by, in relative terms, a deterioration in the cooling action or, with a high coolant pressure, by in relative terms a higher differential pressure load on the components. This is because the cooling medium has a low heat capacity at a low density and therefore the heat transfer and dissipation which it brings about is reduced. Nevertheless, even a closed system is an active cooling system which is able to cool the casing shell 23 significantly more successfully compared to passive cooling or compared to just limited cooling in the inflow region of a casing.

The open channel system 28 firstly has a continuous passage along the axis 25, from which a plurality of branches bend off toward the overflow openings 29*a*. Furthermore, this is a combined channel system 28, in the sense that separate further channels, which could run out of the wall, are, as far as possible, avoided. This has the advantage that the cooling steam mass flow and the required temperature difference can decrease from stage to stage and that the same cooling steam can act over a plurality of stages. By comparison with the individual channels 16 which are known from the prior art shown in FIG. 1 in a rotor or a casing, these channels being guided separately, the pressure required is based on the highest pressure of the main flow. With the separate channels according to the prior art, a pressure for the subsequent stages would no longer be matched. This leads to an additional load on the turbine resulting from a higher differential pressure. A higher pressure in separate channels would also, for a plurality of blade/vane rows, lead to a considerable increase in the mechanical load, for example in a part-joint screw connection of the steam turbine casing. Also, additional outlay for the provision of different pressure stages and their introduction into the blading region would have to be made available for separate channels, which is disadvantageous. In principle, however, as explained in the general part of the description, a passage system could, as a modification, be of flexible design and could also be composed of subsystems.

Figure 3:
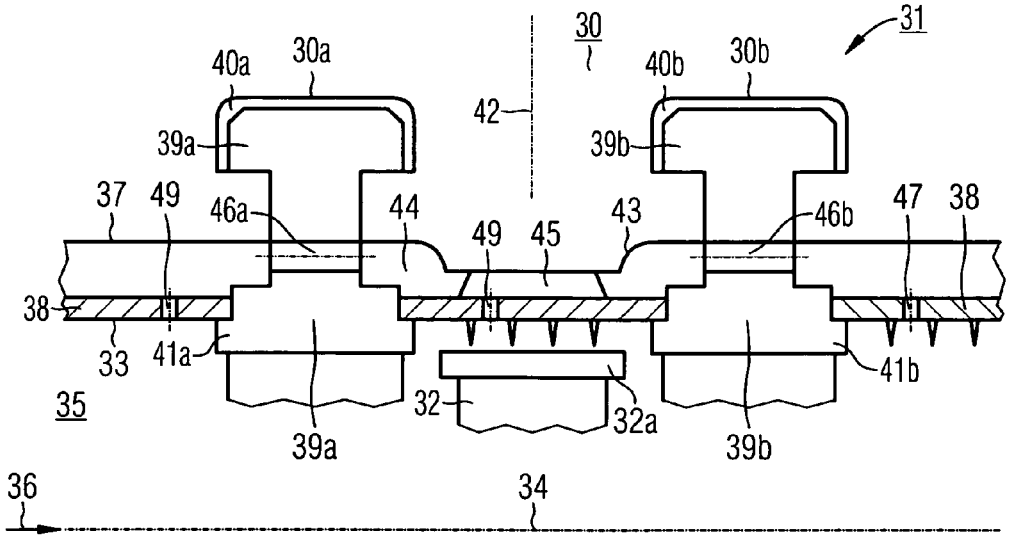
FIG. 3 depicts the feed of the cooling medium and the guiding of the cooling medium in a channel system, which is integrated in the casing close to the surface, in the blading region for the preferred embodiment.

FIG. 3 provides a more detailed illustration of the casing shell 30 in accordance with the preferred embodiment, in the region of the cooled blading. Furthermore, a corresponding steam turbine 31 has a rotor (not shown) with rotor blading formed by a number of rotor blades 32. The casing shell 30 in this case provides a first location 30*a* and a second location 30*b* along the inner side 33, with the second location 30*b* arranged behind the first location 30*a* along the axial extent 34. The inner side 33 adjoins an inner space 35, which is intended to receive a main flow 36 of a fluid working medium. In this case, however, the inner side 33 is not formed by a wall 37 of the casing shell 30, but rather by a stationary shielding plate 38 which is held by the vane roots 39. Furthermore, the vane roots 39*a*, 39*b* are anchored in vane grooves 40*a*, 40*b* in the wall 37. A number of vanes 41*a* are arranged next to one another, in each case in a radial orientation 42, along the circumference of the casing shell 30, thereby forming a first ring of guide vanes, also referred to as a row of guide vanes, at the location 30*a*. In a corresponding way, a number of second vanes 41*b* are arranged next to one another circumferentially in the vane groove 40*b* at a second location 30*b*, forming a second ring of guide vanes.

An additional or alternative modification to the shielding plate 38 illustrated in FIG. 3 could also be provided by a shielding surface formed at the vane roots 39*a*, 39*b*. Although this would require additional outlay on materials and production, it would be possible to achieve a similar shielding action to that provided by a shielding plate 38, which could be advantageous depending on the particular requirements.

The channel system 43 shown in FIG. 3 has at least one passage 44 which is arranged between the outer side and the inner side 33 of the casing shell 30 and extends continuously at least between a first region arranged in front of the first location 30*a* and a second region arranged behind the second location 30*b*. In this embodiment, the passage 44 extends along virtually the entire blading region in that part of the casing which is subject to a relatively high temperature. The passage 44 is formed firstly by the wall 37 of the casing shell 30 and secondly by the shielding plate 38. A multiplicity of these passages 44 are arranged in the axial extent 34 along the inner side 33 at the circumference of the casing shell 30.

Moreover, the channel system 43 includes a number of circumferentially running grooves 45, which, in the present embodiment, are arranged along the axial extent 34, in each case at the level of a rotor blade 32. The rotor blade 32 has a cover plate 32*a*. The passages of the channel system 43 can be applied by milling into the wall 37 of the casing shell 30 and can be covered by are al components of the shielding plate 38. In this case, the channel system 43 also incorporates vane grooves (FIG. 9, FIG. 10) and/or bores 46*a*, 46*b* (FIG. 5, FIG. 6, FIG. 9, FIG. 10) in vane roots 39*a*, 39*b* in the flow profile.

Moreover, the channel system 43 has overflow openings 47, 48 and 49 for matching the parameters of the coolant flow to the parameters of the working medium flow. This is achieved by interaction with the flow resistances of the channel system by releasing some of the cooling medium flow to the main flow.

The shielding provided by a shielding plate 38 in the blading region can be achieved by also shielding the inflow region of the cooling medium by means of a further shielding plate, which is not shown here, providing further advantages with regard to oxidation of the turbine casing material.

As an alternative or in addition to a shielding plate 38, it is also possible for the channel system 43 or a passage 44 to be arranged in the form of bores or in some other suitable way inside a wall 37 of a casing shell 30, close to the surface.

Figure 4:
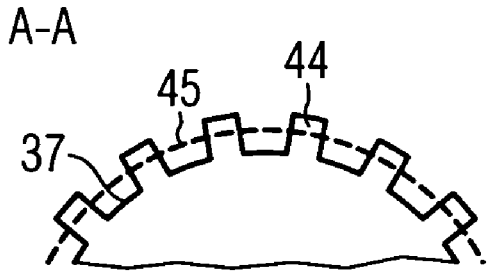
FIG. 4 shows a detailed view on section line A—A of the channel system shown in FIG. 3.

FIG. 4 shows the view on section line A—A from FIG. 3. In this figure, the encircling groove 45 shown in FIG. 3 is indicated by a dashed line. Accordingly, the passage 44, which is designed as an axial groove, is diagrammatically indicated as an indentation in the surface of a wall 37 of the steam turbine casing.

Figure 5:
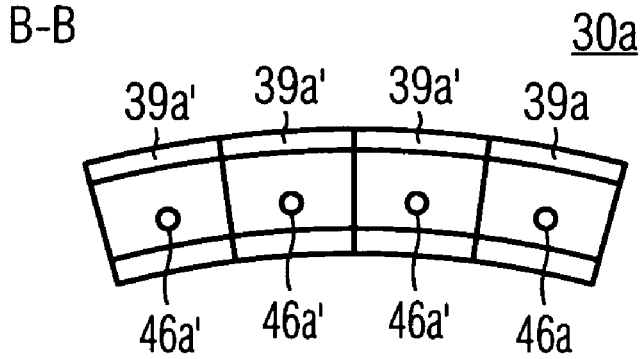
FIG. 5 shows a detailed illustration on section line B—B of the channel system shown in FIG. 3.

FIG. 5 shows a possible way of arranging a bore 46*a* in a vane root 39*a*. A multiplicity of vane roots 39*a*, 39*a*' arranged circumferentially next to one another along the inner casing, with bores 46*a*, 46*a*', forms a row of vanes at the location 30*a*.

Figure 6:
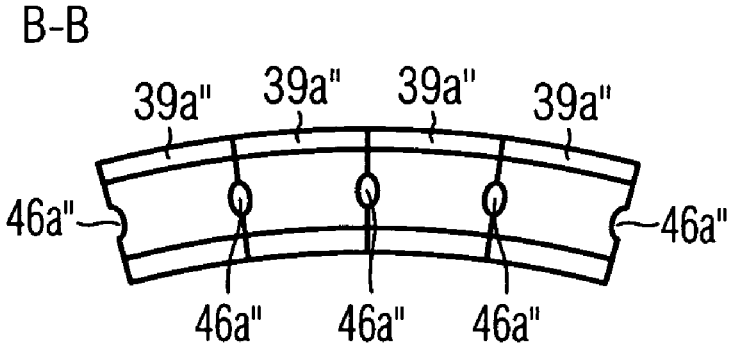
FIG. 6 shows a detailed illustration on section line B—B for a modified configuration of the channel system shown in FIG. 3.

An alternative configuration of the bores 46*a*, 46*a*' in FIG. 3 is illustrated in FIG. 6 as bore 46*a*". A bore 46*a*" is arranged in two respectively adjacent vane roots 39*a*".

Unlike in gas turbines, in steam turbines the working medium which flows to a part-turbine is at its highest pressure at the same time as it is at its highest temperature. To realize in particular an open cooling system for a steam turbine, therefore, suitable measures have to be taken to supply the cooling medium. The cooling medium can be supplied after such a medium has been removed from the water-steam circuit at a location of higher pressure and sufficiently low temperature. Suitable removal locations include in particular:

- prior to entry into the superheater parts of the boiler connected upstream of the part-turbine,
- before entering the boiler at all,
- after exiting from an upstream part-turbine from a tapping point from an upstream part-turbine,
- by separate provision by means of a suitable pump which removes the cooling medium from the preheating section at a low-pressure location and then pressurizes it to the required pressure. In the event of cooling failure in the event of the pump failing, additional outlay, if appropriate a redundant design, is required.

Figure 7:
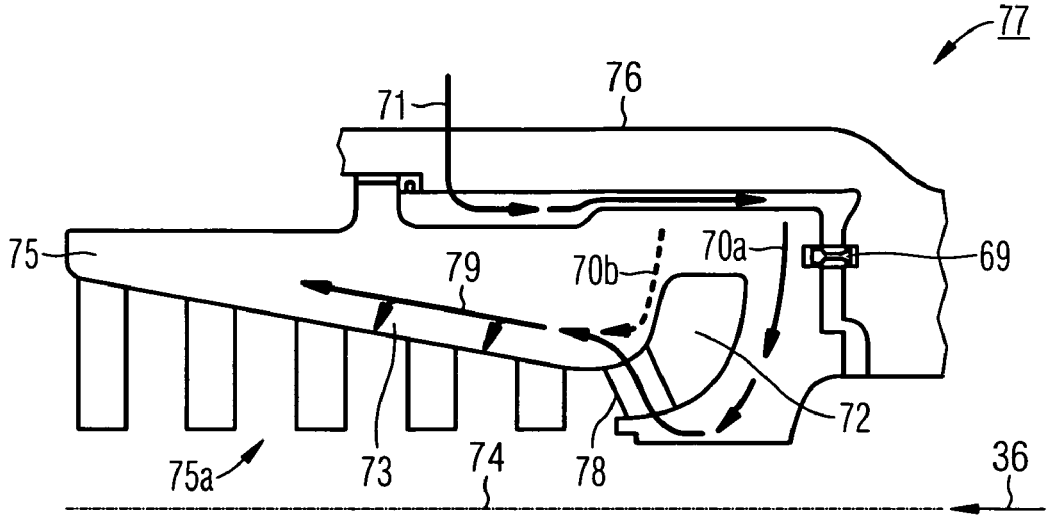
FIG. 7 diagrammatically depicts a possible way of transferring the cooling medium into the region where the rotor blades are secured in accordance with the preferred embodiment.

FIG. 7 shows a first possibility and a second possibility for transferring a cooling medium 71 from a region 72 in front of a first row 78 of guide vanes to a further region 73 where the guide vanes are secured along the axial extent 74. This figure illustrates an inner casing 75 according to the preferred embodiment, which is arranged in an outer casing 76 of a steam turbine 77. The cooling medium can be introduced via a feed 70*a* and the first row 78 of guide vanes into a channel system 79, which is close to the surface, in the inner casing 75 and can be guided along the axial extent 74 in the region of the guide vane blading 75*a*. As an alternative or in addition, cooling medium can also be introduced into the channel system 79 directly in the inner casing 75 via a feed 70*b*, without first being guided over a first row 78 of guide vanes.

The further flow of cooling medium 71 in the outer casing 76 is passed through a number of seals 69, throttles and other suitable measures. The incoming flow of cooling medium is controlled by a valve which satisfies safety requirements.

In addition to the possibilities for introducing the cooling medium shown in FIG. 7, it would also be possible for cooling medium to be introduced into the channel system 79 which is integrated in the casing in the region where the working medium flows in.

When the cooling medium emerges at the end of the channel system 79 and passes into the main flow, the cooling medium is substantially matched to the main flow, not only in terms of pressure but also in terms of temperature. This is a consequence of the uptake of heat by the cooling medium in the cooled blading region. The cooling medium then takes part in the further expansion in the main flow. This is a particular advantage of an open cooling system, which therefore transports enthalpy from the cooled blading region into the uncooled region.

The safety monitoring of the cooling medium in the embodiment shown here has in particular to control the temperature of the cooling medium. In this context, it should be ensured that premature condensation/droplet formation in the flow and in the channel system is avoided, even at partial loads. Furthermore, overheating of the main components, such as casing, guide vanes and vane-securing regions should be eliminated for all relevant load situations. Depending on the technical requirements, trimming between turbine valves and cooling medium valves may be provided for.

The described channel system of the preferred embodiment can also advantageously be used for preheating purposes by virtue of suitable medium being fed in during the starting-up operation. This medium can also be taken from other locations in the water-steam circuit than what subsequently forms the actual cooling medium. The fact that the preheating medium is throttled in the channel system and at least here does not contribute to running up a shaft section, has an advantageous effect in this context. This method can also be used analogously for rapid cooling. The procedures outlined above may offer advantages in terms of the start-up times and cooling times for future inner casings or inner casing materials.

Figure 8:
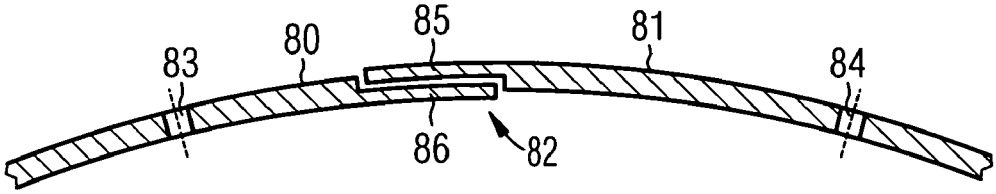
FIG. 8 illustrates a configuration of a first and second shielding plate in an overlap region.

FIG. 8 shows a favorable arrangement of a first shielding plate 80 and a second shielding plate 81 in the region of an abutment joint 82. The detail design illustrated here can advantageously be implemented for a shielding plate 38 with overflow openings 83 and 84 in FIG. 8 or 47, 48 and 49 in FIG. 3. A shielding plate of this type is advantageously made from a suitable material, for example a material which is able to withstand high temperatures. In this embodiment, it comprises partial pieces, which at their abutment joints 82 preferably have a covering 85, 86 which is moveable in order to cope with different temperatures. In the configuration shown in FIG. 3, the shielding plate is located in the region of the rotor blade cover plates and should have corresponding sealing tips, i.e. Contact less seals. For this purpose, sealing tips could be formed in the region of the abutment joint 82 or adjacent to the blade roots by turning, i.e. machined out of the solid material, or sealing strips could be jammed in. Which option proves advantageous can be determined in detail according to the strength and manufacturing requirements of the material and the specific design.

If the cooling medium is released to the main flow via the shaft seal of the rotor blades, the efficiency loss can under certain circumstances be reduced by the leakage mass flow which flows via these seals. In this case, the leakage mass flow consists not of hot medium from the main flow, but rather of cooling medium with a lower enthalpy. However, it is possible that this effect will be counteracted again by a reduced number of sealing tips resulting from the space which is needed to introduce the cooling medium. In this context, various configurations are possible and will prove advantageous depending on the particular requirements.

Figure 9:
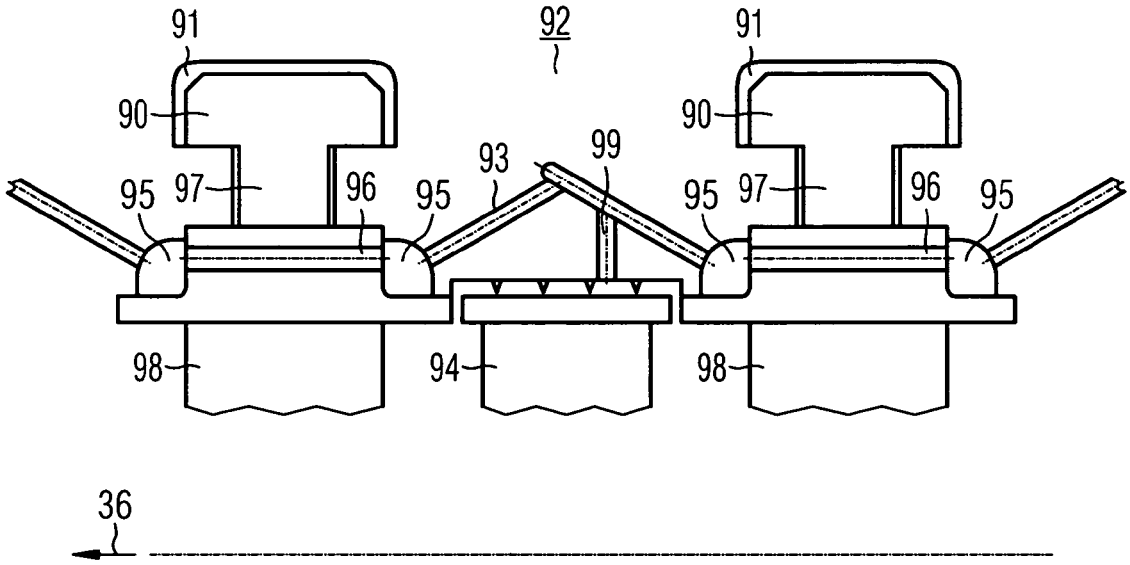
FIG. 9 illustrates a further possible configuration of the channel system for guiding the cooling medium in the region of the guide vane blading.

FIG. 9 shows a further configuration of a channel system for guiding the cooling medium in the region of a vane root 90 which is anchored in a groove 91 in a turbine casing 92. The axial passage 93 of the preferred embodiment is recessed deeper into the interior of the turbine casing 92 in the region of a rotor blade 94 and therefore has, for example, a triangular profile in the region of the rotor blade 94. Any other profile is possible. The passage 93 is open to the main flow via channels 99. A vane groove 95 is additionally incorporated into the region of the passage. Moreover, passage through a vane root 90 is effected by means of a channel 96 which is arranged above the constricted waist 97 of the vane root, closer to the main vane part 98. This has the advantage of having no adverse effect on the strength of the constricted waist 97.

Figure 10:
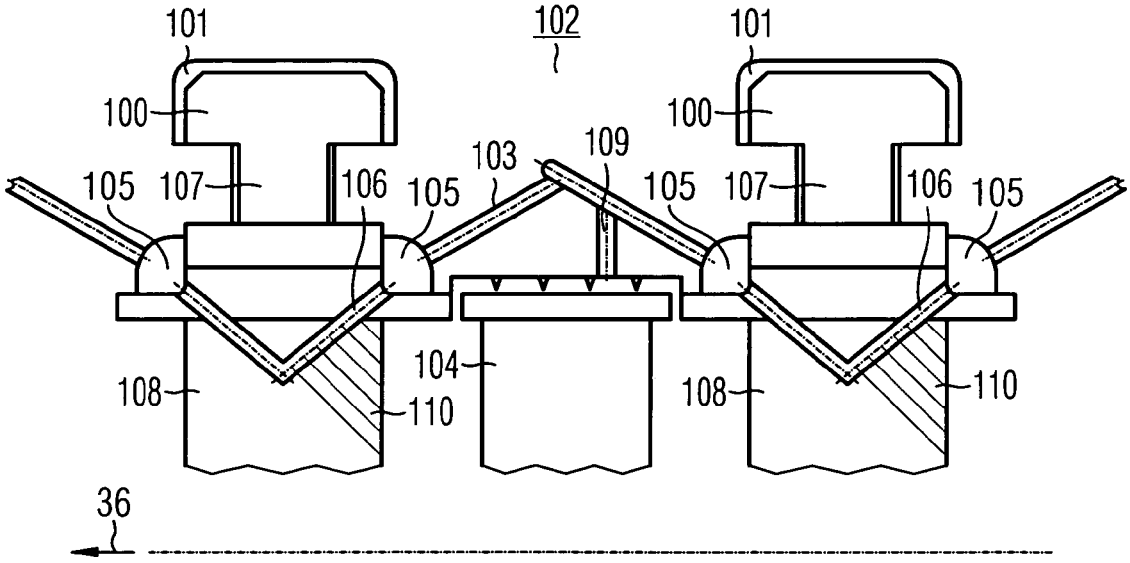
FIG. 10 illustrates yet a further possible configuration of the channel system for guiding the cooling medium in the region of the guide vane blading.

FIG. 10 shows yet another configuration which is similar to that shown in FIG. 9. Unlike in FIG. 9, a passage 106 is also provided in the region of a main vane part 108. Channels 110 which pass cooling medium from a passage 106 onto the main vane part 108, in order to provide film cooling, lead off from the passage 106 in the region of the main vane part 108.

Furthermore, cooling medium is also released to the main flow of the working medium via a channel 109 in the region of a rotor blade 104. Further details correspond to those shown in FIG. 9.

To summarize, the invention proposes a steam turbine casing, a steam turbine and a method for actively cooling a steam turbine casing, as well as a suitable use of the cooling.

In steam turbines 1 which have been disclosed hitherto, a casing is either only cooled passively or is only cooled actively to a limited extent in an inflow region of the working medium. As the loads on the casing increase as a result of increased steam parameters of the working medium, sufficient cooling of the steam turbine casing is no longer ensured. The proposed casing shell 23, 30 or the proposed inner casing 75 extends along an axis 25 or along an axial extent 34 and includes: an inner wall 26 along the axis 25 or the axial extent 34, an outer side 23*a* of the inner wall 26, an inner side 23*b*, 33, which adjoins an inner space 27*a*, 35 intended to receive a main flow 27, 36 of a fluid working medium 8, a first location 30*a* along the inner side 23*b*, 33, at which a first vane 41*a* is held, a second location 30*b* along the inner side 23*b*, 33, at which a second vane 41*b* is held, the second location 30*b* being arranged behind the first location 30*a* along the axis 25 or the axial extent 34. To ensure sufficient cooling, at least one passage 44, 93, a bore 46*a*, 46*b*, a channel 96 is provided, this passage, bore, channel, which is arranged between the outer side 23*a* and the inner side 23*b*, 33, extending continuously at least between a first region 28*a*, 72 arranged in front of the first location 30*a* and a second region 28*b*, 73 arranged behind the second location 30*b*. The invention also proposes a method and use in which a fluid cooling medium 10 is guided in a corresponding way.

The invention claimed is:

1. A steam turbine comprising:

a rotor having a plurality of rotor blades;

a plurality of guide vanes spaced apart from the blades; and a casing shell formed by a plurality of casing segments, at least one of the casing segments provided with at least one integrated cooling channel, wherein the rotor and the plurality of guide vanes are arranged inside the casing shell, wherein the cooling channel is oriented substantially in the longitudinal direction of the rotor.

2. The steam turbine as claimed in claim 1, wherein the cooling channel is positioned inside a wall of a corresponding casing segment, the cooling channel offset toward a inner surface of said wall relative to a center plane.

3. The steam turbine as claimed in claim 2, wherein the rotor blades and guide vanes-form a plurality of blade/vane rows, the cooling channel extending over at least two successive blade/vane rows, as viewed in the longitudinal direction of the rotor.

4. The steam turbine as claimed in claim 2, wherein the cooling channels are combined to form a common cooling system which is integrated in the casing shell.

5. The steam turbine as claimed in claim 2, wherein the cooling channel is connected via a number of overflow openings to a flow space for a flow medium, the flow space surrounded by the casing shell.

6. The steam turbine as claimed in claim 1, wherein the rotor blades and guide vanes form a plurality of blade/vane rows, the cooling channel extending over at least two successive blade/vane rows, as viewed in the longitudinal direction of the rotor.

7. The steam turbine as claimed in claim 1, wherein the cooling channels are combined to form a common cooling system which is integrated in the casing shell, and wherein a plurality of guide vanes are attached to the casing shell, wherein each of the guide vanes is cooled via an integrated branch channel connected to the cooling system.

8. The steam turbine as claimed in claim 1, wherein the cooling channel is connected via a number of overflow openings to a flow space for a flow medium, the flow space surrounded by the casing shell.

9. The steam turbine as claimed in claim 8, wherein the respective cooling channel and the overflow openings are dimensioned such that in the operating state the coolant is at a slightly higher pressure than the flow medium.

10. The steam turbine as claimed in claim 9, wherein the cooling channel has at least one overflow opening for each turbine stage.

11. A method for operating a steam turbine having a casing shell formed by a plurality of casing segments, comprising:

providing at least one cooling channel integrated into a casing segment or a casing shell;

at least partially admitting coolant via the cooling channel to the casing shell delimiting the space for a flow medium; and flowing a coolant through the cooling channel, wherein the coolant is steam, wherein the coolant entering from the cooling passage is admixed to the flow medium, and wherein the coolant is fed into the flow medium at a pressure which is more than the pressure prevailing in the flow medium at the corresponding mixing location.

12. The method as claimed in claim 11, wherein the coolant is guided at a pressure which, as viewed in the longitudinal direction of the rotor, is matched to the pressure prevailing locally in the flow space of the flow medium.

13. A steam turbine comprising:

a rotor having a plurality of rotor blades;

a plurality of guide vanes spaced apart from the blades; and a casing shell formed by a plurality of casing segments, at least one of the casing segments provided with at least one integrated cooling channel, wherein the rotor and the plurality of guide vanes are arranged inside the casing shell, and a cooling medium comprising steam flows through the cooling channel, wherein the cooling channel is positioned inside a wall of a corresponding casing segment, the cooling channel offset toward a inner surface of said wall relative to a center plane, and wherein the cooling channel is oriented substantially in the longitudinal direction of the rotor.

* * * * *